US006269795B1

(12) United States Patent
Ripper et al.

(10) Patent No.: US 6,269,795 B1
(45) Date of Patent: Aug. 7, 2001

(54) FUEL INJECTION VALVE FOR INTERNAL COMBUSTION ENGINES

(75) Inventors: Wolfgang Ripper, Stuttgart; Werner Wagner, Gerlingen; Bernd Dittus, Tamm; Manfred Mack, Altheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/341,756

(22) PCT Filed: Jun. 17, 1998

(86) PCT No.: PCT/DE98/01649

§ 371 Date: Jul. 16, 1999

§ 102(e) Date: Jul. 16, 1999

(87) PCT Pub. No.: WO99/28616

PCT Pub. Date: Jun. 10, 1999

(30) Foreign Application Priority Data

Nov. 27, 1997 (DE) ..... 197 52 496

(51) Int. Cl.[7] ..... F02M 37/04
(52) U.S. Cl. ..... 123/467; 123/447; 239/533.9
(58) Field of Search ..... 123/467, 447, 123/500, 501, 446; 239/533.9

(56) References Cited

U.S. PATENT DOCUMENTS 1,597,317 * 8/1926 Jorgensen ..... 123/467
1,944,371 * 1/1934 Ritz ..... 123/467
3,738,576 * 6/1973 O'Neill .
3,810,453 * 5/1974 Wolfe ..... 123/467
4,091,771 * 5/1978 Rapp et al. ..... 123/275
4,417,693 * 11/1983 Fussner et al. ..... 239/453
4,537,359 * 8/1985 Skinner ..... 239/533.6
5,941,215 * 8/1999 Augustin ..... 123/467

FOREIGN PATENT DOCUMENTS

2088948 * 6/1982 (GB) .

* cited by examiner

*Primary Examiner*—Carl S. Miller
(74) *Attorney, Agent, or Firm*—Ronald E. Greigg; Edwin E. Greigg

(57) ABSTRACT

A fuel injection valve for internal combustion engines, having a valve member that is axially displaceable in a valve body and that with a sealing face cooperates, to control an injection opening, with a valve seat face on the valve body. An end of the valve member remote from the combustion chamber is urged in the closing direction by a valve spring disposed in a spring chamber. The valve member has a pressure shoulder acting in the opening direction, which protrudes into a pressure chamber that is filled with high fuel pressure. Via a throttle gap, the spring chamber communicates with the pressure chamber and is sealed off from a fuel return system, so that during the opening stroke motion of the valve member the spring chamber acts as a hydraulic damper.

5 Claims, 1 Drawing Sheet

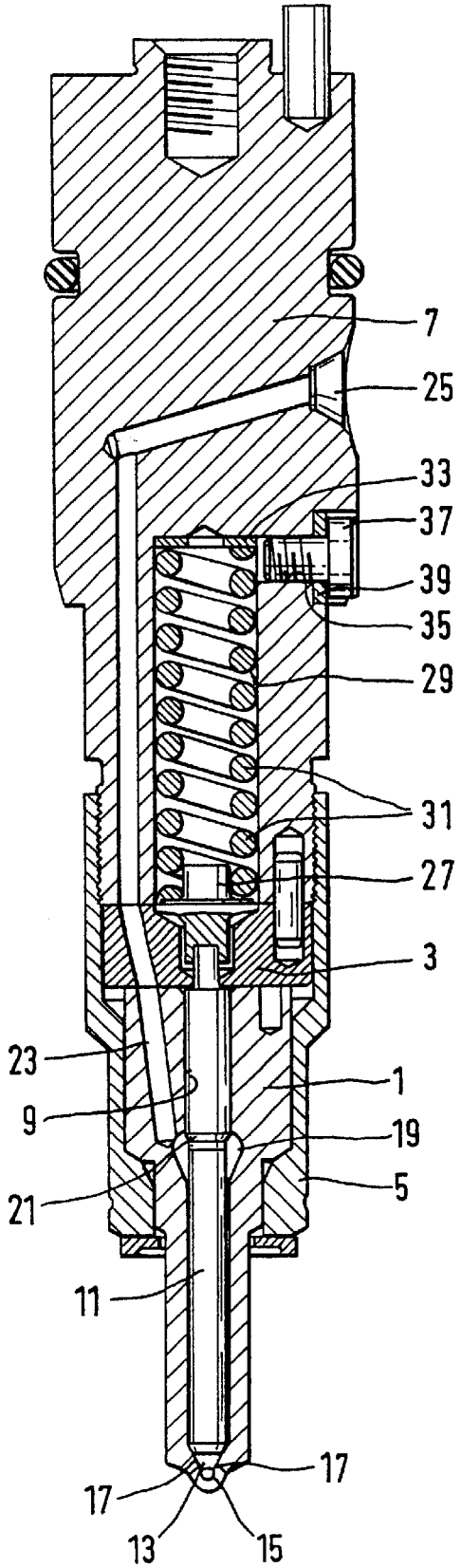
7
25
33
37
39
35
29
31
27
3
23
1
9
19
21
5
11
17
17
13
15

FUEL INJECTION VALVE FOR INTERNAL COMBUSTION ENGINES

PRIOR ART

The invention is based on a fuel injection valve for internal combustion engines. In one such fuel injection valve, known from German patent disclosure DE 44 40 182 A1, a piston-like valve member is axially displaceably guided in a guide bore of a valve body. The valve body has a sealing face on its end toward the combustion chamber, and with this face the valve body cooperates with a valve seat face disposed on the valve body, in order to control an injection opening. With its end remote from the combustion chamber, the valve member protrudes into a spring chamber, in which at least one valve spring is disposed that urges the valve member in the closing direction toward the valve seat face. The valve member also has a pressure shoulder, which protrudes into a pressure chamber that can be filled with high fuel pressure, and this shoulder is embodied such that the high fuel pressure engaging the pressure shoulder urges the valve member in the opening direction, counter to the restoring force of the valve springs.

To generate a two-stage opening stroke course in the known fuel injection valve, this valve has two axially in-line valve springs, which during the opening stroke course of the valve member become operative in succession, thus creating a staged opening of the opening cross section at the injection valve. A damping chamber defined by the valve member is also provided in the known injection valve; it can be closed during the opening stroke motion of the valve member in such a way that the pressure built up in the dumping chamber counteracts the opening stroke motion of the valve member during the remaining stroke thereof, so that a two-stage shaping of the injection course can be performed even at high rpm and at full load.

The known fuel injection valve has the disadvantage, however, that because it requires two valve springs and the additional damping chamber, it is very large in size and takes up a large amount of installation space, which is often unavailable in modern internal combustion engines. Moreover, manufacturing the known fuel injection valve is relatively complicated and thus expensive.

ADVANTAGES OF THE INVENTION

The fuel injection valve for internal combustion engines according to the invention, has the advantage over the prior art that the spring chamber itself is utilized as a hydraulic damper. This becomes possible in a structurally simple way as a result of not draining the leaking oil quantity out of the spring chamber; as a result, the fuel-filled pressure chamber acts as a hydraulic work chamber, which brings an additional closing force to bear on the valve member. The hydraulic closing force of the damping chamber has a variable effect depending on the engine operating state, that is, the rpm, load and temperature. The degree of damping or the closing force can be adjusted by way of the play between the valve member and the guide bore wall guiding the valve member, and by way of the size of the damping volume of the spring chamber. Along with shaping the opening course, the closing stroke motion of the valve member can also be varied; the closing pressure in the spring chamber, which rises as the load and rpm rise, also brings about faster closure of the valve member at the end of injection. This kind of fast closure of the valve member prevents combustion gases from being blown back into the injection valve and thus prevents damage to the sealing seat.

The load- and rpm-dependent hydraulic closing pressure in the spring chamber thus makes a low opening pressure of the fuel injection valve possible; along with the damping of the valve member stroke, the result is that the ignition lag during injection in the engine is shortened, which thus lessens the noise of combustion. When the still-cold engine is started, this effect of the valve member stroke damping is amplified by the viscosity of the fuel, which thus compensates for the increased combustion noise of the Diesel engine in this operating state. The highest closing pressure in the spring chamber prevails when the rated rpm range is reached, and then the fast closure of the valve member prevents combustion gases from being blown back.

With the fuel injection valve of the invention, it is thus possible in a structurally simple way to perform a shaping of the injection course at the fuel injection valve for the sake of noise abatement.

Further advantages and advantageous features of the subject of the invention can be learned from the specification, the drawing and the claims.

BRIEF DESCRIPTION OF THE DRAWING

One exemplary embodiment of the fuel injection valve for internal combustion engines of the invention is shown in the drawing and will be described in further detail below. FIG. 1 shows an exemplary embodiment of the fuel injection valve in a longitudinal section.

DESCRIPTION OF THE EXEMPLARY EMBODIMENT

The fuel injection valve for internal combustion engines shown in FIG. 1 has a valve body 1, which together with a shim 3 that contacts its face end remote from the combustion chamber is firmly fastened on a valve holding body 7 by means of a union nut 5. The valve body 1, protruding with its end remote from the shim 3 into a combustion chamber, not shown, of an internal combustion engine has a guide bore 9, in which a piston-like valve member 11 is axially displaceably guided; on one face end, the valve member has a conical sealing face 13, with which it cooperates with a valve seat 15 formed by a reduction in the diameter of the guide bore 9. This valve seat 15 is disposed on the closed end toward the combustion chamber of the valve body 1 and borders on injection openings 17, provided on the end of the guide bore 9, which adjoin the valve seat 15 downstream in the injection direction. The guide bore 9 of the valve member 11 is widened at one point to form a pressure chamber 19, in whose region the valve member 11 has a pressure shoulder 21 and which communicates, via an inlet conduit 23, with a connection stub 25 on the valve holding body 7, to which a fuel feed line not shown, from a high-pressure fuel pump is connected. The pressure chamber 19 communicates in a known manner with the valve seat 15 or the injection openings 17, via an annular gap between the shaft of the valve member 11 and the wall of the guide bore 9. With its end remote from the combustion chamber, the valve member 11 protrudes into a spring plate 27, which extends, penetrating the shim 3, as far as the inside of a spring chamber 29 in the valve holding body 7. A valve spring 31 is fastened in this spring chamber 29; with its lower end, toward the combustion chamber, it rests on the spring plate 27, and with its upper end it is supported in stationary fashion on the upper end wall of the spring chamber 29 in the valve holding body 7. To adjust the spring prestressing force, an adjusting shim 33 is provided between the upper spring chamber wall and the upper end of the valve spring 31. An opening bore 35 in the valve holding body 7 is also provided, which opens from the outside in the spring chamber 29. A closure screw 37 is screwed into this opening bore 35; a sealing shim 39 is fastened between the housing and the closure screw 37. The hydraulic filling volume of the spring chamber 29 can be varied by way of the thickness of the sealing shim 39 or the depth to which the closure screw 37 is screwed in. For filling the spring chamber 29 with fuel, the valve member 11 and the spring plate 27 have a play from the wall of the guide bore 9 and the shim 3, respectively, and these respective plays form a throttle gap between the pressure chamber 19 and the spring chamber 29, by means of which a throttled overflow of fuel out of the pressure chamber 19 into the spring chamber 29 is possible. This throttled overflow cross section can also be formed by longitudinal recesses on the valve member 11, so that sufficient guiding surface areas for secure axial guidance of the valve member 11 are furnished.

The fuel injection valve of the invention for internal combustion engines functions as follows. Before the onset of high-pressure fuel injection, the pressure chamber 19 and by way of the presure chamber 19 the spring chamber 29 as well are filled with fuel whose pressure is equivalent to the static pressure in the high-pressure supply line system. The valve member 11 is kept in contact with the valve seat 15 by the closing force of the valve spring 31. With the onset of high-pressure fuel injection, fuel at high pressure from the high-pressure fuel pump passes via the inlet conduit 23 into the pressure chamber 19, where it urges the valve member 11, at the pressure shoulder 21, in the opening stroke direction. If the opening force engaging the pressure shoulder 21 exceeds the closing force of the valve spring 31, the valve member 11 is displaced from the valve seat 15 in the opening stroke direction. The injection cross section between the sealing face 13 and the valve seat 15 is opened in the process, so that the fuel present at the valve seat 15, which is at high pressure, passes through the injection openings 17 to attain injection into the combustion chamber of the engine. The fuel volume enclosed in the spring chamber 29 acts as a hydraulic damper, counteracting the opening stroke motion of the valve member 11, so that the opening stroke motion of the valve member 11 is initially slowed down. In this way, at the onset of the high-pressure fuel injection, only a relatively small opening cross section is initially opened, so that only a slight preinjection quantity reaches the engine combustion chamber and thereby brings about a slight ignition lag. After the further rise of the pressure in the pressure chamber 19, this hydraulic damping force in the spring chamber 29 and the closing force of the valve spring 31 are further exceeded, so that the now ensuing opening stroke motion of the valve member 11 can proceed quickly. In the process, the hydraulic pressure in the spring chamber 29 rises further, because of the volume positively displaced by the spring plate 27. At the end of the high-pressure injection, the high fuel pressure in the pressure chamber 19 collapses and drops below the closing force of the valve member 11, which force is the sum of the closing force of the valve spring 31 and the hydraulic pressure force in the spring chamber 29. This increased closing force at the valve member 11 brings about a very rapid return displacement of the valve member 11 onto the valve seat 15, thereby assuring a rapid closure of the fuel injection valve.

The spring chamber 29 acting as a hydraulic work chamber has a variable rpm- or load-dependent effect depending on the engine operating state; if the load and rpm are increasing, rising closing pressures in the spring chamber 29 are attained. The magnitude of the damping of the opening stroke motion of the valve member 11 can also be adjusted and optimized by way of the size of the throttle gap between the pressure chamber 19 and the spring chamber 29 and by way of the magnitude of the hydraulic damping volume in the spring chamber 29.

The foregoing relates to preferred exemplary embodiments of the invention, it being understood that other variants and embodiments thereof are possible within the spirit and scope of the invention, the latter being defined by the appended claims.

We claim:

1. A fuel injection valve for internal combustion engines, comprising a valve member (11) which is axially displaceable in a valve body (1) and which with a sealing face (13) provided on its end toward the combustion chamber cooperates, in order to control an injection opening (17) with a valve seat (15) disposed on the valve body (1), and whose end remote from the combustion chamber is urged in the closing direction toward the valve seat (15) by a valve spring (31) disposed in a spring chamber (29) and the valve member has a pressure shoulder (21), acting in the opening direction, which protrudes into a pressure chamber (19) that is filled with fuel at a high pressure, the spring chamber (29) communicates via a throttle cross section with the pressure chamber (19), and in which an opening bore (35) discharges into the spring chamber (29) is provided, a closing screw (37) is sealingly screwed into a valve holding body which contains said spring chamber, and the hydraulic volume of the spring chamber (29) can be varied by way of a depth to which the screw is screwed in to said spring chamber.

2. The fuel injection valve according to claim 1, in which the throttle cross section between the pressure chamber (19) and the spring chamber (29) is embodied as an annular throttle gap between the valve member (11) and a guide bore wall (9).

3. The fuel injection valve according to claim 1, in which the spring chamber (29), during the opening phase of the fuel injection valve, acts as a hydraulic work chamber, which brings an additional closing force to bear on the valve member (11).

4. The fuel injection valve according to claim 1, in which a spring plate (27) rests on the end of the piston-like valve member (11) remote from the combustion chamber, and is acted upon by a valve spring (31), on a side remote from the valve member and a flow cross section is provided between the spring plate (27) and a housing wall surrounding the spring plate.

5. The fuel injection valve according to claim 1, in which an adjusting shim (33) is fastened between the valve body (1) and a valve holding body (7).

* * * * *